US007182225B2

(12) United States Patent
Garcia et al.

(10) Patent No.: US 7,182,225 B2
(45) Date of Patent: Feb. 27, 2007

(54) FLUID DISPENSER MEMBER

(75) Inventors: Firmin Garcia, Evreux (FR); Hervé Pennaneac'h, Verneuil sur Avre (FR)

(73) Assignee: Valois S.A.S., Neubourg (FR)

( * ) Notice: Subject to any disclaimer, the term of this patent is extended or adjusted under 35 U.S.C. 154(b) by 232 days.

(21) Appl. No.: 11/033,891

(22) Filed: Jan. 13, 2005

(65) Prior Publication Data

US 2005/0184100 A1 Aug. 25, 2005

Related U.S. Application Data

(60) Provisional application No. 60/561,512, filed on Apr. 13, 2004.

(30) Foreign Application Priority Data

Feb. 23, 2004 (FR) ..... 04/01789

(51) Int. Cl.
*B65D 88/54* (2006.01)

(52) U.S. Cl. ..... 222/321.3; 222/321.7; 222/321.9; 222/380; 222/383.1; 222/321.2

(58) Field of Classification Search ..... 222/321.2, 222/380, 321.3, 321.4, 182, 321.6, 321.7, 222/321.9, 383.1; 239/333
See application file for complete search history.

(56) References Cited

U.S. PATENT DOCUMENTS 4,111,367 A * 9/1978 Hayes ..... 239/333
4,402,432 A * 9/1983 Corsette ..... 222/321.2
4,591,077 A 5/1986 Corsette
5,641,097 A * 6/1997 Renault et al. ..... 222/321.2
6,012,615 A * 1/2000 Brunet et al. ..... 222/321.2
6,932,246 B2 * 8/2005 Crosnier et al. ..... 222/321.2
2002/0047025 A1 * 4/2002 Ray ..... 222/321.3
2005/0133535 A1 * 6/2005 Garcia ..... 222/156

* cited by examiner

*Primary Examiner*—Frederick C. Nicolas
(74) *Attorney, Agent, or Firm*—Sughrue Mion, PLLC

(57) ABSTRACT

A fluid dispenser member having a dispensing wall (623) defining an outside surface and inside surface, said wall being provided with a through dispensing orifice (625) connecting the inside surface to the outside surface, the inside surface forming a leaktight slide cylinder for a piston (632, 633) suitable for moving in leaktight contact inside said cylinder for selectively unmasking the dispensing orifice, said piston forming a wall element of a fluid chamber inside which fluid is selectively put under pressure, said fluid dispenser member being characterized in that the inside surface extends over two surface segments, namely a top segment (6232) and a bottom segment (6242), the top segment having an inside diameter that is smaller than the inside diameter of the bottom segment, the dispensing orifice being formed at the top segment, and the piston being provided with a sealing lip (633) in leaktight sliding contact with the bottom segment.

10 Claims, 3 Drawing Sheets

FLUID DISPENSER MEMBER

CROSS REFERENCE TO RELATED APPLICATION

This application claims the benefit under 35 U.S.C. §119 (e) of pending U.S. provisional patent application Ser. No. 60/561,512, filed Apr. 13, 2004, and priority under 35 U.S.C. §119(a)–(d) of French patent application No. FR-04.01789, filed Feb. 23, 2004.

TECHNICAL FIELD

The present invention relates to a fluid dispenser member that is generally designed to be associated with a fluid reservoir so as to constitute therewith a fluid dispenser. It is a dispenser member that is generally actuated manually by means of a user's finger. The fluid is dispensed in the form of a sprayed stream of fine droplets, a continuous trickle, or a dollop of fluid, in particular for viscous fluids, such as cosmetic creams. Such a fluid dispenser member can, in particular, be used in the fields of perfumes, cosmetics, or indeed pharmaceuticals, for dispensing fluids of various viscosities.

The present invention relates more particularly but not exclusively to a type of dispenser member that can be referred to as a "pusher-pump". That name can be explained by the fact that the dispenser member comprises a pusher that not only forms a dispensing orifice but also defines a portion of a fluid chamber inside which fluid is selectively put under pressure. When the dispenser member is a pump, that chamber is a pump chamber. A particularity of such a pusher-pump lies in the fact that an inside surface of the pusher, which surface is substantially cylindrical in general shape, serves as a leaktight slide cylinder for a piston that moves in leaktight contact inside said cylinder, thereby selectively unmasking the dispensing orifice. In general, the piston is a piston of the differential type which moves in response to variation in the pressure of the fluid inside the chamber. The differential piston should be distinguished from the main piston which is caused to move by actuating the pusher. Thus, such a pusher-pump includes a differential piston and a main piston, which pistons can move in leaktight contact in respective cylinders. The main cylinder for the main piston can also be formed by the pusher.

BACKGROUND OF THE INVENTION

That applies in particular in the pump described in Document WO 97/23304. The pusher has a push wall on which pressure is exerted by means of a finger for the purpose of actuating the pusher. In addition, the pusher has a skirt that extends downwards from the push wall. Said skirt forms a first leaktight slide cylinder for a differential piston and a main second cylinder for the main piston of the pump. The differential piston is dissociated from the main piston. The differential piston is urged away from the push wall by a spring that serves both as a return spring and as a precompression spring. The slide cylinder for the differential piston is provided with an outlet duct that leads to a nozzle received in a recess formed in the skirt of the pusher. The nozzle forms a dispensing orifice via which the fluid is discharged from the dispenser member. In addition, the recess formed by the skirt is provided with a swirl system which co-operates with the nozzle to entrain the fluid in a swirling movement before it is discharged through the dispensing orifice. The swirl system is conventionally made up of one or more tangential swirl channels opening out into a swirl chamber accurately centered on the dispensing orifice. The swirl system is in the form of a network recessed into the recess in the skirt. The recessed network is then associated with the separate nozzle that comes to isolate the swirl channels and the chamber. Thus, the slide cylinder of the differential piston is in the form of a cylindrical surface interrupted only at the outlet channel. When the pusher is pressed, the main piston rises up inside the main cylinder of the pusher, thereby causing the differential piston to move by sliding in leaktight manner inside the differential cylinder. That causes the spring to be compressed: the differential piston then moves upwards towards the push wall of the pusher. The active sealing lip of the differential piston, which lip is directly in contact with the fluid, slides in the bottom portion of the cylinder that is situated below the outlet channel. As soon as the differential piston reaches the outlet duct, the fluid put under pressure in the chamber is delivered from the chamber through said duct and reaches the nozzle, where it is swirled and discharged through the dispensing orifice.

The pump of Document WO 97/23304 is made up of five essential component elements, namely a body designed to be associated with a fluid reservoir, the pusher, a ball forming an inlet valve member, the differential piston, and the nozzle. The body forms the main piston.

BRIEF SUMMARY OF THE INVENTION

An object of the present invention is to simplify a dispenser member of the type described in the above-mentioned prior art document so as to reduce the number of component parts. A particular object is to omit a separate nozzle. Another object is to retain the swirl system which contributes to the quality with which the fluid is dispensed. Another object of the invention is to improve co-operation between the differential piston and the piston, in particular the leaktight sliding contact, and the establishment of the outlet passageway for the fluid.

To achieve some of these objects, the present invention provides a fluid dispenser member having a dispensing wall defining an outside surface and inside surface, said wall being provided with a through dispensing orifice connecting the inside surface to the outside surface, the inside surface forming a leaktight slide cylinder for a piston suitable for moving in leaktight contact inside said cylinder for selectively unmasking the dispensing orifice, said piston forming a wall element of a fluid chamber inside which fluid is selectively put under pressure, said fluid dispenser member being characterized in that the inside surface extends over two surface segments, namely a top segment and a bottom segment, the top segment having an inside diameter that is smaller than the inside diameter of the bottom segment, the dispensing orifice being formed at the top segment, and the piston being provided with a sealing lip in leaktight sliding contact with the bottom segment.

This type of dispenser may be a pump of the pusher-pump type, but it may also be any other type of dispenser member in which the pusher is dissociated from the dispensing wall. It is possible, in particular, to make provision for the dispensing wall to be fixed relative to the reservoir, or else mounted to move relative to the pusher. Advantageously, the slide cylinder, the dispensing orifice and the swirl system are formed integrally with the dispensing wall.

Advantageously, at the top segment, the inside surface forms a fluid swirl system immediately upstream from the dispensing orifice. Causing the lip to slide over a segment that is offset relative to the segment in which the dispensing orifice is formed is particularly advantageous for molding the dispensing wall. The dispensing wall is generally made of an injection-molded plastics material. For this purpose, a mold is used that is made up of a plurality of elements. One of said elements forms in particular a core for forming the inside surface of the dispensing wall. In the present invention, said core must form the swirl system. Since the swirl system extends by forming a portion that is recessed into the slide cylinder, the core must form a corresponding cavity insert that projects outwards. Thus, while the core is being withdrawn, during unmolding, the projecting insert must be withdrawn by force. The projecting insert must therefore come out of the recessed portion that it has formed, and must move along an axial extent of the slide cylinder. Given that the plastics material can creep, forcing the projecting insert through marks the slide cylinder only very little. Thus, by providing a guide wall with an inside surface having a diameter greater than the inside diameter of the slide cylinder, the projecting insert of the core can be withdrawn past it without biting into the inside surface of the guide wall. As a result, the projecting insert of the core is withdrawn under force over only a small axial extent of the slide cylinder: the risks of the slide cylinder being damaged during removal of the molding core are thus limited.

However, the invention is not limited to the case when the dispensing wall forms a swirl system.

In another embodiment, the piston is provided with a second lip in leaktight sliding contact with the top segment.

In a variant, the piston is out of contact with the top segment. In which case, there is no top lip.

According to another characteristic which may be implemented independently of the characteristics related to the lip of the piston, the piston is provided with a leaktight abutment edge in leaktight abutting contact against an abutment surface, the piston being urged resiliently against said leaktight abutment surface in the rest position, the leaktight contact between the abutment edge and the abutment surface hermetically isolating the chamber from the dispensing orifice.

Advantageously, the abutment surface is frustoconical and urges the abutment edge radially outwards. Advantageously, the dispensing wall is formed by a pusher comprising a push wall which is extended at its outer periphery by the dispensing wall, the abutment surface being formed by the push wall.

In another aspect, the surface segments are cylindrical and interconnected by a transition segment, which is advantageously frustoconical.

According to another characteristic which may also be implemented independently, the dispensing wall is formed by a substantially cylindrical skirt further provided with a guide wall defining an inside surface which advantageously extends substantially in alignment with the bottom segment, the guide wall being provided with internal fastening means in abutment with external holding means.

In another aspect, the sealing lip in contact with the bottom segment is resiliently urged towards the top segment in the rest position.

The abutment edge may be implemented without the bottom lip mounted to slide against a larger-diameter bottom segment.

An advantageous aspect of the invention lies in the fact that the wall through which a dispensing orifice passes also internally forms a fluid swirl system.

BRIEF DESCRIPTION OF THE DRAWINGS

The invention is described more fully below with reference to the drawings which show an embodiment of the invention by way of non-limiting example.

In the figures.

DETAILED DESCRIPTION OF THE INVENTION

Figure 1:
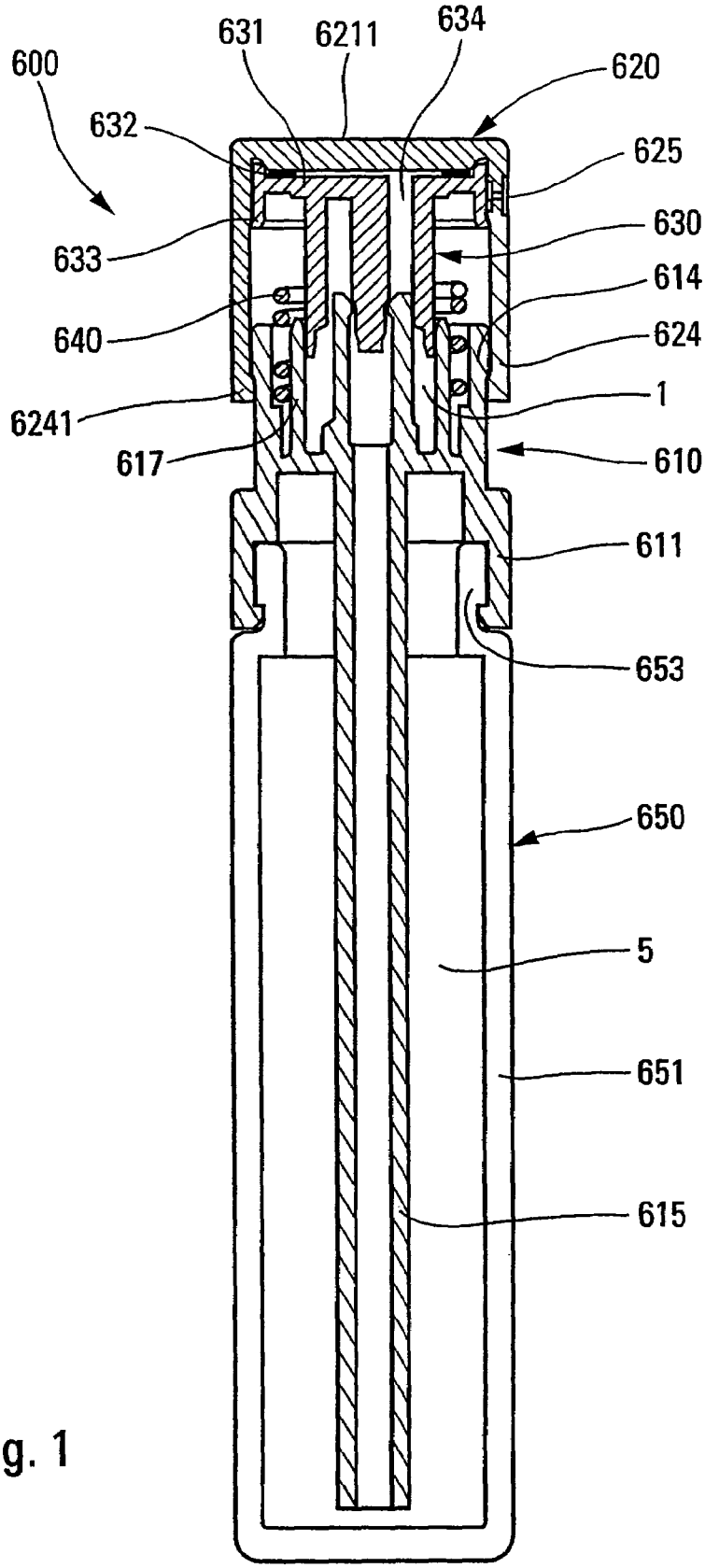
FIG. 1 is a vertical section view through a dispenser equipped with an embodiment of a dispenser member of the invention in the rest state.
Figure 2:
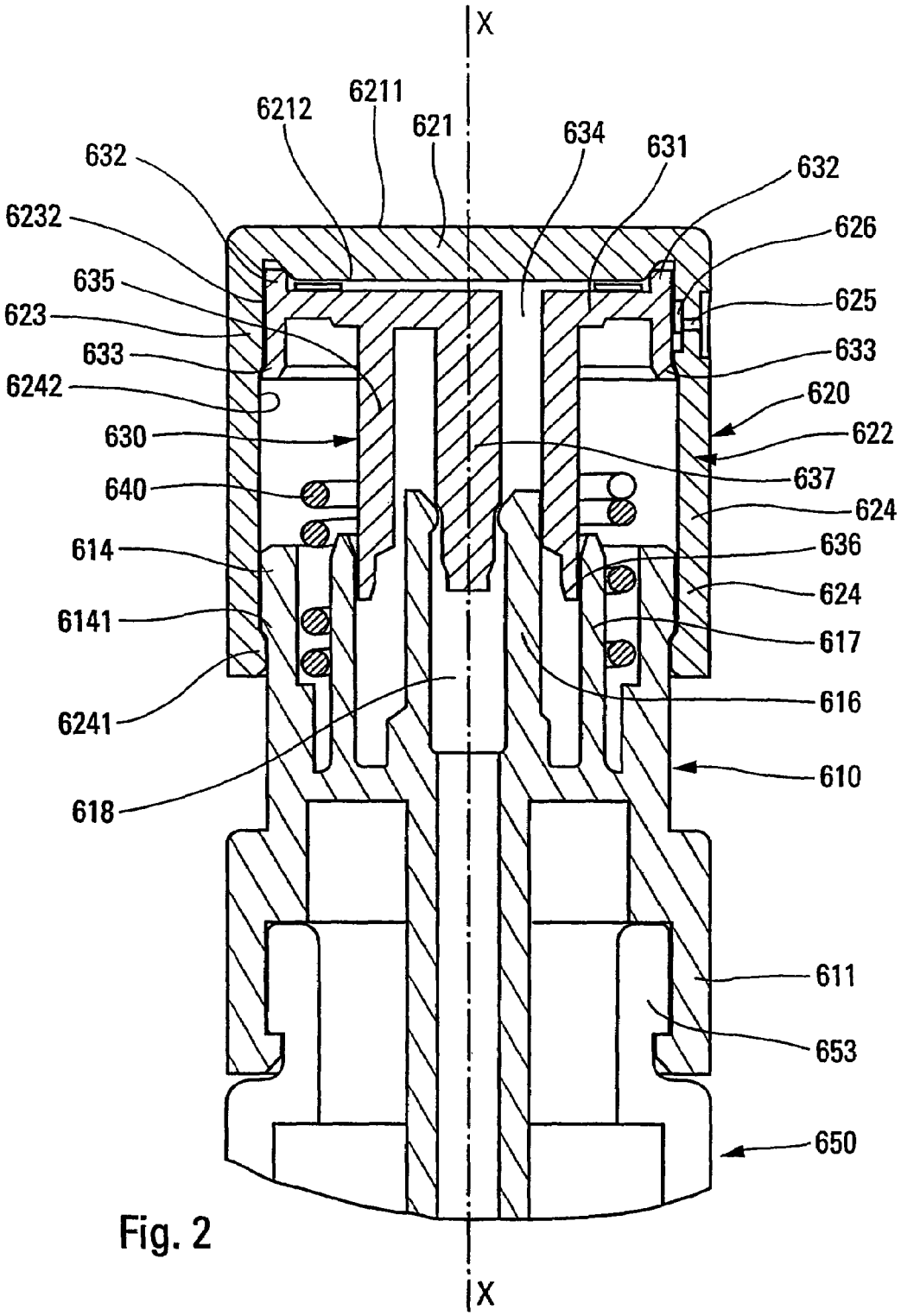
FIG. 2 is a fragmentary view of FIG. 1 on a larger scale.

The dispenser member 600 in FIGS. 1 and 2 is shown associated with a receptacle 650 comprising a body 651 internally defining a fluid reservoir 5. At its top end, the body 651 is provided with an opening in the form of a neck 653 which serves for fixing the dispenser member of the invention.

The dispenser member 600 comprises three component elements, namely a body 610, a pusher 620, and a piston 630. The dispenser member further comprises spring means 640 which, in this example, are in the form of a coil spring. The body, the pusher and the piston member are preferably made of molded plastics material. The dispenser member is designed as a pump having a pump chamber 1.

The body 610 comprises a fixing ring 611 which cooperates with the neck 653 to fix the member to the receptacle 650. The ring 611 is in engagement with the outside of the neck 653. The body 611 also forms a guide and hold band 614. The top end of the guide band 614 is provided with an external shoulder 6141 which serves as external holding means. The body also forms a main cylinder 617 which internally defines a leaktight sliding surface whose function is given below. The body also forms a dip tube 615 which extends inside the receptacle 650. At its top end, the dip tube 615 is extended by an inlet sleeve 616 which forms an inlet valve profile or seat. An inlet duct 618 passes through the dip tube 615 and through the sleeve 616. The inlet sleeve 616 extends concentrically inside the main cylinder 617 so that an annular space is formed between them.

The body 610 is circularly symmetrical about an axis X which extends longitudinally at the axial center of the inlet duct 618.

This is a particular design for a particular dispenser member in a non-limiting embodiment of the invention. Naturally, the body can have characteristics other than the above-described characteristics without going beyond the ambit of the invention.

The pusher 620 forms a dispensing head for the dispensing member. The pusher 620 comprises a push wall 621 and a peripheral skirt 622 which extends downwards from the outer periphery of the push wall. Thus, the pusher 620 is in the general shape of an upside-down cup whose push wall forms the bottom and whose skirt forms the cylindrical side wall. However, the skirt is not necessarily cylindrical in shape. It can be frustoconical or rounded in section.

The push wall 621 has a push outside surface 6211 on which it is possible to push with one or more fingers. In addition, the push wall 621 has an inside surface 6212 which advantageously forms one or more abutment stud(s) 6213.

The skirt 622 has a dispensing top wall 623 and a guide bottom wall 624. At its top end, the dispensing wall 623 is connected to the outer periphery of the push wall 621. The dispensing wall 623 has an outside surface and an inside surface. The inside surface is preferably circularly cylindrical and defines a slide cylinder as explained below. The inside surface defines two cylindrical inside surface segments 6232 and 6242 interconnected via a transition segment 6243 which may be step-shaped or frustoconical. The two segments comprise a top segment 6232 and a bottom segment 6242. The top segment has an inside diameter smaller than the inside diameter of the bottom segment. The top segment is connected to the push wall, and more particularly to the inside surface 6212 of the push wall. Where the top segment 6232 meets the inside surface 6212, a peripheral annular groove 6213 is formed that is provided with an abutment surface 6213 that is advantageously implemented frustoconically.

The top segment is provided with a through dispensing orifice 625 which extends from the inside surface to the outside surface. The dispensing orifice 625 can open out into a dispensing dish 6251 on the outside surface.

According to an advantageous characteristic of the invention, the top segment 6232 of the dispensing wall 623 is provided with a swirl system 626 which makes it possible to rotate fluid in the form of a swirl whose eye is centered on the dispensing orifice. Thus, the dispensing wall 623, which is advantageously formed integrally with the push wall 621 and with the guide wall 624, is provided with a through dispensing orifice and has an inside surface provided with a swirl system, at the top segment.

The guide wall 624 extends in alignment with the dispensing wall 621, and more particularly with the bottom segment 6242. The boundary between the guide wall and the dispensing wall is not clearly defined, so that the bottom segment can be considered as being part of the dispensing wall and/or as part of the guide wall. The outside wall of the guide wall is provided with an abutment bead 6241 serving to co-operate with the shoulder 6141 of the guide band 614. The guide wall 624 surrounds the guide band 614 concentrically. The abutment bead 6241 makes it possible to secure the pusher to the body, which can thus only move axially over a maximum stroke determined by the distance between the bottom end of the guide wall and the fixing ring 611.

Figure 3:
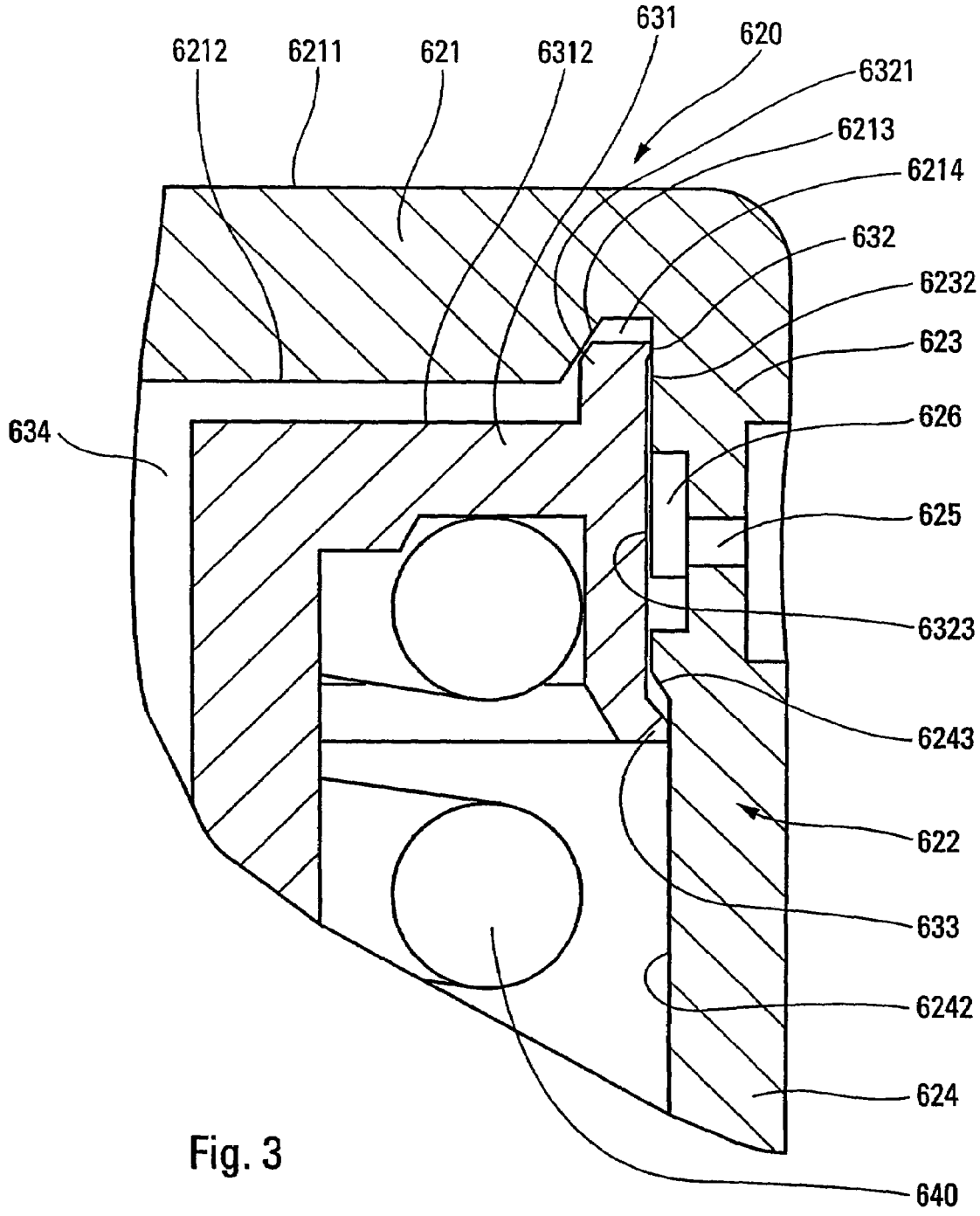
FIG. 3 is a view of a detail the dispenser member of the invention on an even larger scale.

In this embodiment, the piston member 630 comprises a main piston 636 engaged to slide in leaktight manner in the main cylinder 617, and a differential piston formed by two lips 632 and 633 in leaktight sliding contact in the cylinder formed by the inside surface 6232 of the dispensing wall 623. The two lips 632 and 633 are formed at the outer periphery of the disk 631. The piston member 630 is advantageously formed integrally as a single piece. The lips 632 and 633 extend one above the other with spacing greater than the axial extent of the swirl system 626. In the rest position, shown in FIG. 1, the top lip 632 is in contact with the top segment 6232 above the swirl system 626, while the bottom lip 633 comes into contact with the bottom segment 6242 below the swirl system 626. Thus, the swirl system cannot communicate with the inside of the pusher except at the space formed between the two lips 632 and 633. This is the rest position into which the piston member 630 is urged against the push wall 621 by the spring 640. It can be considered that the differential piston is formed by the disk 631 that forms the two lips 632 and 633. The piston member is also advantageously provided with an abutment edge 6321 situated in the vicinity of the lip 632. Said edge extends concentrically inside the lip 632, since the lip is formed by an outside edge of an annular flange and the edge is formed by an inside edge of said annular flange. The abutment edge 6321 serves to come into leaktight abutting contact against the leaktight abutment surface 6231 formed by the push wall. The edge is urged by the spring 640 towards the surface, and the leaktight contact is established in the rest position, shown in FIGS. 1 to 3. The frustoconical shape of the surface 6231 tends to push the edge 6321 radially outwards, thereby causing the lip 632 to press the lip 632 harder against the top surface segment 6232. Improved leaktightness is thus obtained in the rest position.

The piston member 630 also forms an axial central rod 637 that extends from the disk 631 away from the push wall 621. The axial rod 637 is engaged in part inside the inlet sleeve 616 formed by the body 610. The rod 637 forms a valve profile 638 serving to co-operate with the corresponding profile formed by the sleeve 616. In other words, the rod 637 in co-operation with the sleeve forms an inlet valve for a pump chamber 1, as explained below. In addition, the piston member 630 forms a piston bushing 635 at the bottom end of which the main piston 636 is formed. The piston bushing 136 extends concentrically around the axial rod 637, so as to define between them an annular duct that extends through the disk 631 via fluid-passing holes 634.

The body 610, the pusher 620, and the piston member 630 together form a pump chamber 1 that extends continuously between the main cylinder 617 and the sleeve 616, between the piston bushing 635 and the axial rod 637, through the holes 634, and between the disk 631 and the inside surface of the push wall 121. Thus, the top surface of the disk 631 and the inside surface form wall elements for the pump chamber 1. In the rest position, shown in FIG. 1, the spring 640 pushes the piston member 630 into abutment against the push wall 621. The inlet valve formed by co-operation between the axial rod 637 and the sleeve 616 is open. The two lips of the differential piston are in contact with the cylinder formed by the inside surface of the dispensing wall 623.

In addition, the abutment edge is in leaktight contact with the abutment surface 6321. The pump chamber is thus fully isolated from the dispensing orifice in the rest position.

When a force is exerted on the push outside surface 6211 of the push wall, the pusher is caused to move axially relative to the body. Since the piston member is in abutment against the push wall, the piston member is pushed by the pusher. In a first stage, movement of the pusher causes the inlet valve to be closed: the axial rod 637 is engaged more deeply into the sleeve 616 until leaktight sliding contact is achieved between the sleeve and the rod. Thus, the pump chamber 1 is isolated from the reservoir 5. As from then, the fluid in the pump chamber 1 is put under pressure. Because the fluid is incompressible, the total working volume of the pump chamber remains constant. But since the main piston 636 penetrates into the cylinder 617, thereby reducing the volume of the bottom portion of the chamber, a new volume must be created. This is made possible by the fact that the differential piston moves away from the push wall 621. This causes the lips 632 and 633 to slide inside the dispensing wall 623 and causes the leaktight contact to cease at the abutment edge 6321. The lips thus move until the top lip 632 reaches the swirl system 626. Whereupon, the fluid under pressure in the pump chamber finds an outlet passageway through the swirl system and through the dispensing orifice. The passageway thus remains open so long as the pressure inside the chamber can overcome the force of the spring. As soon as the pressure inside the chamber decreases below a certain threshold, the spring pushes the differential piston back towards the rest position shown in the figures. The swirl system and the dispensing orifice are then isolated once again from the pump chamber.

It can be noted that the top lip 632 is directly in contact with the fluid, whereas the bottom lip is not directly in contact with the fluid. Thus, the top lip slides in the top portion of the cylinder defined by the top segment above the swirl system. Said top portion offers a surface of quality better than the quality of the surface of the portion below the top segment that extends immediately below the swirl system, which portion might be damaged by the molding core being removed. In addition, the bottom lip 633 slides against the bottom surface segment, which cannot have been damaged by the removal of the molding core that was used to form the swirling system, because its inside diameter is larger than the diameter of the core.

An advantageous characteristic of the invention lies in the fact that the piston member 640 is urged against the push wall 621 and moves under the effect of the increase in pressure inside the pump chamber away from said push wall. This is made possible in particular by means of the fluid-passing holes 634 provided through the disk 631 forming the differential piston. It is thus possible to say that the push wall defines a wall element of the pump chamber.

The differential piston moving away from the push wall in this way, in association with a swirl system formed in the dispensing wall is advantageous for the purposes of unmolding, given that the top lip 632 slides in leaktight manner over the top portion of the slide cylinder, which top portion cannot then be damaged by withdrawing the molding core forming the projecting cavity insert that served to mold the swirl system.

It can also be noted that the rest position is reached when the abutment bead 6241 formed by the guide wall 624 is in abutment under the external shoulder 6141.

It is also quite possible to consider omitting the top lip 632 of the differential piston, so that said differential piston is then provided merely with a bottom lip 633 and with an abutment edge. The edge guarantees static leaktightness at rest, which is sufficient. The bottom lip guarantees dynamic leaktightness during actuation. Thus, the side wall 6323 of the differential piston that faces the dispensing orifice and the swirl system can remain out of contact with the dispensing wall except at the bottom lip 633.

As soon as the abutment bead lifts off the abutment surface, the passageway between the chamber and the dispensing orifice is established. It is not necessary to have a sealing lip that scrapes over the top segment at which the dispensing orifice is formed, and advantageously at which the swirl system is formed.

By means of the invention, a lip of the differential piston slides in a cylinder which cannot be damaged by the molding core being removed, particularly when the dispensing wall forms a swirl system. The difference in diameter between the top segment and the bottom segment makes it possible to obtain this result.

In addition, the pusher sliding around the band of the body makes it possible to implement a dispenser in which the diameter of the pusher is identical or larger than the diameter of the body and of the reservoir. The pusher can extend in alignment with the reservoir, thereby imparting a more tubular appearance to the dispenser. This characteristic can be implemented independently of the characteristics related to the differential piston.

The invention claimed is:

1. A fluid dispenser member (600) having a dispensing wall (623) defining an outside surface and inside surface, said wall being provided with a through dispensing orifice (625) connecting the inside surface to the outside surface, the inside surface forming a leaktight slide cylinder for a piston (632, 633) suitable for moving in leaktight contact inside said cylinder for selectively unmasking the dispensing orifice, said piston forming a wall element of a fluid chamber (1) inside which fluid is selectively put under pressure, said fluid dispenser member being characterized in that the inside surface extends over two surface segments, namely a top segment (6232) and a bottom segment (6242), the top segment having an inside diameter that is smaller than the inside diameter of the bottom segment, the dispensing orifice being formed at the top segment, and the piston being provided with a sealing lip (633) in leaktight sliding contact with the bottom segment.

2. A fluid dispenser member according to claim 1, in which the piston is provided with a second lip (632) in leaktight sliding contact with the top segment.

3. A fluid dispenser member according to claim 1, in which the piston is out of contact with the top segment.

4. A fluid dispenser member according to claim 1, in which the piston is provided with a leaktight abutment edge (6321) in leaktight abutting contact against an abutment surface (6213), the piston being urged resiliently against said leaktight abutment surface in the rest position, the leaktight contact between the abutment edge and the abutment surface hermetically isolating the chamber from the dispensing orifice.

5. A fluid dispenser member according to claim 4, in which the abutment surface is frustoconical and urges the abutment edge radially outwards.

6. A fluid dispenser member according to claim 1, in which the surface segments are cylindrical and interconnected by a transition segment (6243), which is advantageously frustoconical.

7. A fluid dispenser member according to claim 1, in which the dispensing wall is formed by a substantially cylindrical skirt (622) further provided with a guide wall (624) defining an inside surface which advantageously extends substantially in alignment with the bottom segment, the guide wall being provided with internal fastening means (6241) in abutment with external holding means (6141).

8. A fluid dispenser member according to claim 4, in which the dispensing wall is formed by a pusher comprising a push wall which is extended at its outer periphery by the dispensing wall, the abutment surface being formed by the push wall.

9. A fluid dispenser member according to claim 1, in which, at the top segment, the inside surface forms a fluid swirl system (626) immediately upstream from the dispensing orifice.

10. A fluid dispenser member according to claim 1, in which the sealing lip (633) in contact with the bottom segment is resiliently urged towards the top segment in the rest position.

* * * * *